US005702561A

United States Patent [19]

Phillips

[11] Patent Number: 5,702,561

[45] Date of Patent: Dec. 30, 1997

[54] PANEL CLAMPING AND ASSEMBLY RACK

[76] Inventor: Bradley R. Phillips, 1 Pondora Dr., Buckhannon, W. Va. 26201

[21] Appl. No.: 567,687

[22] Filed: Dec. 5, 1995

[51] Int. Cl.[6] ..... B30B 15/00

[52] U.S. Cl. ..... 156/580; 269/10; 269/16; 269/17; 269/93

[58] Field of Search ..... 156/580, 581, 156/583.1; 269/9, 10, 16, 17, 93

[56] References Cited

U.S. PATENT DOCUMENTS

| | | | |
|---|---|---|---|
| 3,642,269 | 2/1972 | Ladd | 269/40 |
| 4,132,396 | 1/1979 | Graham | 269/41 |
| 4,138,099 | 2/1979 | Englehart | 269/17 |
| 4,527,786 | 7/1985 | Hsu | 269/154 |
| 4,542,891 | 9/1985 | Kirby | 269/16 |
| 4,746,141 | 5/1988 | Willis | 280/655 |
| 5,226,656 | 7/1993 | Mayer | 280/79.2 |
| 5,259,601 | 11/1993 | Vass | 269/11 |
| 5,284,331 | 2/1994 | Lee et al. | 269/16 |
| 5,318,316 | 6/1994 | Shurtlaff | 280/79.7 |
| 5,401,354 | 3/1995 | Calucci | 156/580 |
| 5,494,553 | 2/1996 | Colucci | 156/580 |

*Primary Examiner*—James Sells
*Attorney, Agent, or Firm*—David L. Volk

[57] ABSTRACT

An apparatus and method is provided for glueing, assembly and clamping of large wood panels. Comprised of an open rack frame containing a quantity of clamping and assembly jigs, such that two separate and independent wood panels can be at various stages of completion. Each clamping and assembly jig consists of a spacer bar upon which the raw wood stock is placed and a clamping bar which provides pressure perpendicular to the surface of the panel. To use the present invention, wood stock of appropriate dimensions is coated with glue and placed within one or more of the clamping and assembly jigs. Conventional bar clamps are then used to provide pressure on a horizontal axis through the wood panel. Finally, the clamping bar is tightened to aid in alignment of the wood stock and eliminate bowing of the stock.

1 Claim, 3 Drawing Sheets

PANEL CLAMPING AND ASSEMBLY RACK

BACKGROUND OF THE INVENTION

1. Field of the Invention

The present invention relates generally to clamping assemblies and, more particularly, to a glue clamping rack which can be utilized to aid in the glueing and assembly of large, flat panels.

2. Description of the Related Art

In the related art, many methods for clamping objects are known. For example, in U.S. Pat. No. 5,401,354, issued in the name of Colucci, a multipurpose clamping apparatus is disclosed for joining the confronting edges of two boards together during a glueing process. However, a clamping apparatus as disclosed in the Colucci reference is not designed for, nor can it be adapted to join large, flat, panels.

Also, in U.S. Pat. No. 4,132,396, issued in the name of Graham, a glueing clamp assembly is disclosed forming a rectangular clamping assembly. Once again, such a clamping assembly, although particularly well adapted for glueing boxes or frames, is not designed for, nor can it be adapted to join large, flat, panels.

In other arts, the problems associated with handling large, flat sheets have been addressed. For example, in U.S. Pat. No. 5,318,316, issued in the name of Shurtleff, a cart for vertically oriented longitudinally extending objects is disclosed. Also, in U.S. Pat. No. 5,226,656, issued in the name of Mayer, a wheeled carrier for panel materials is disclosed. And finally, in U.S. Pat. No. 4,746,141, issued in the name of Willis, a door carrier is disclosed and described.

Consequently, due to the problems associated with handling and glueing large flat panels, a need has been long felt for providing an apparatus and method which can be utilized to aid in the glueing of large, flat panels.

SUMMARY OF THE INVENTION

It is therefore an object of the present invention to provide an improved device for aiding in the glueing and assembly of wood panels.

It is a further object of the present invention to provide an improved device for aiding in the assembly of wood panels and goods such as cabinets, countertops, and the like, with a lightweight, mobile, and inexpensive device.

It is a further object of the present invention to provide an improved device for aiding in glueing and assembly of wood panels which prevents glue from running off the gluing surfaces of glued strips prior to clamping, resulting in a final product which is much more neat in appearance.

It is yet another object of the present invention to provide an improved device which allows for the simultaneous yet independent assembly of two panels.

It is a feature of the present invention to provide an improved device for aiding in the assembly of wood panels which maintains the wood panels, once they have been glued, in a vertical position, rather than the traditional horizontal position.

Briefly described according to the preferred embodiment of the present invention, an apparatus and method is provided for glueing, assembly and clamping of large wood panels. Comprised of an open rack frame containing a quantity of clamping and assembly jigs, such that two separate and independent wood panels can be at various stages of completion. Each clamping and assembly jig consists of a spacer bar upon which the raw wood stock is placed and a clamping bar which provides pressure perpendicular to the surface of the panel. To use the present invention, wood stock of appropriate dimensions is coated with glue and placed within one or more of the clamping and assembly jigs. Conventional bar clamps are then used to provide pressure on a horizontal axis through the wood panel. Finally, the clamping bar is tightened to aid in alignment of the wood stock and eliminate bowing of the stock.

An advantage of the present invention is that the assembly of wood panels can be accomplished in a manner which allows rough, un-planed strips of wood to be assembled prior to planing, resulting in a final product which is much more neat in appearance.

Another advantage of the present invention is that wood panels can be glued, maintained and stored in a vertical position, rather than the traditional horizontal position.

A further advantage of the present invention is that it prevents bowing of panels during glueing assembly and clamping.

Yet another advantage of the present invention is that is can be utilized to take advantage of ordinary scrap material, allowing for conversion to valuable large, flat panels.

Another advantage of the present invention is that it can be utilized for wide width materials, such as doors, paneling, or stair balusters assemblies.

Further, a preferred embodiment of the present invention is lightweight, mobile, and inexpensive.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
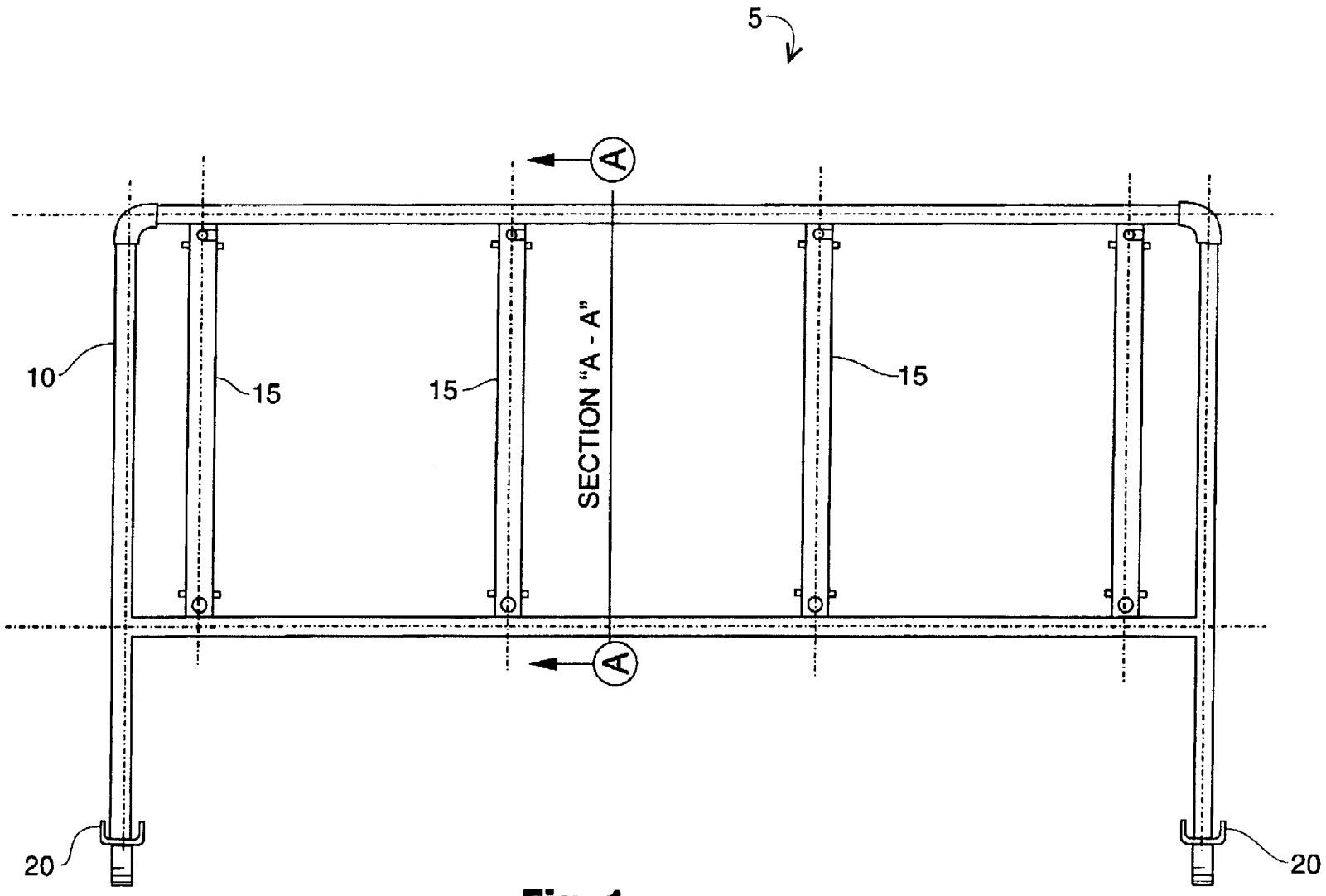
FIG. 1 is a front view of a panel clamping and assembly rack according to the preferred embodiment of the present invention.

Referring now to FIG. 1, a panel clamping and assembly rack 5 is shown, according to the present invention. A rack frame 10, is provided on which a quantity of clamping and assembly jigs 15 are mounted. The clamping and assembly jig 15 will be described in greater detail below. The dimensions of the panel clamping and assembly rack 5 would accommodate a panel of approximate dimensions up to and including 2 feet in width, 8 feet in length and 3 inches in thickness. It can be seen however, by those familiar with the art that other larger dimensions could be accommodated by increasing the dimensions of the panel clamping and assembly rack 5. Provided at the bottom of the panel clamping and assembly rack 5 at each end is a caster assembly 20 which allows for vertical stability of the panel clamping and assembly rack 5 and ease of movement across the shop floor.

Figure 2:
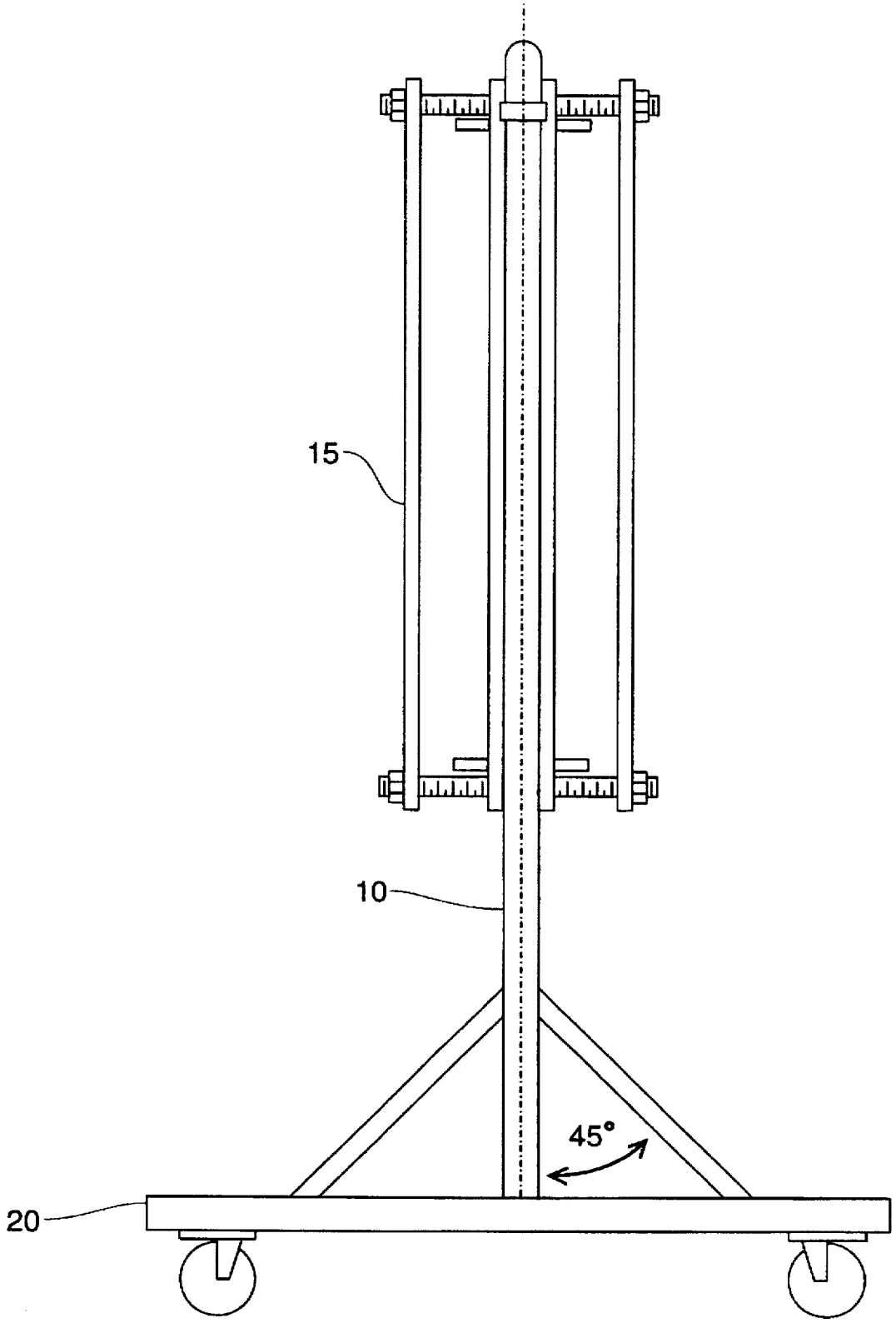
FIG. 2 is a side view thereof.

Referring now to FIG. 2, a side view of the panel clamping and assembly rack 5 is shown. From this view it can be seen that the rack frame 10 and the clamping and assembly jig 15 allow for the simultaneous and independent glueing, assembly and clamping of two panel assemblies. This feature allows for increased productivity and better scheduling of panel assembly, especially on large multi-panel projects.

Figure 3:
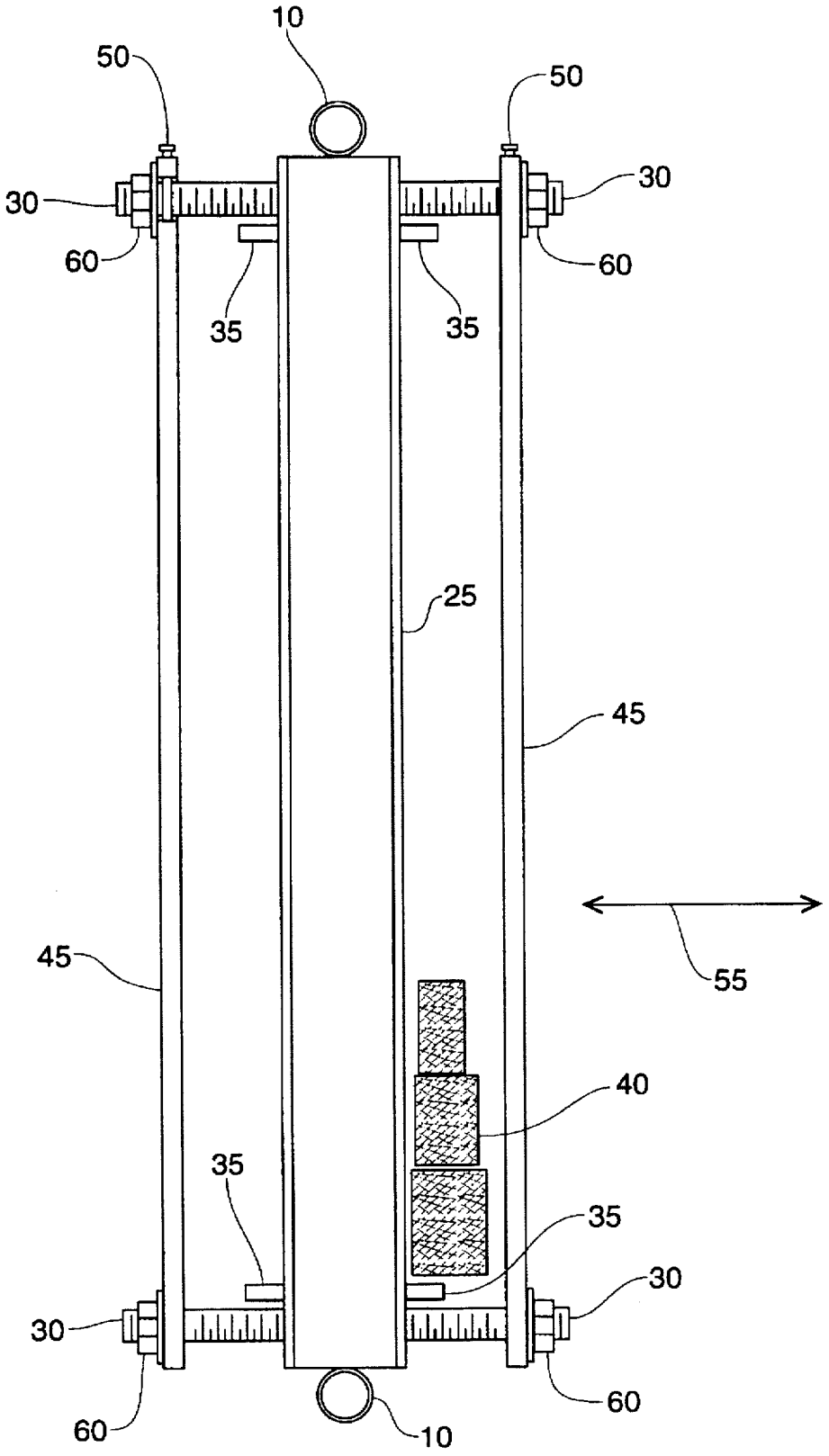
FIG. 3 is a sectional view taken along lines A—A in FIG. 1.

Finally, FIG. 3 shows a sectional view taken along lines A—A in FIG. 1. This view depicts the clamping and assembly jig 15 in greater detail. A center support channel 25 is provided which is in firm mechanical contact with the rack frame 10 at its top and bottom ends. Provided at each corner of the center support channel 25 is a threaded rod 30 for a total quantity of four for each clamping and assembly jig 15. Each threaded rod 30 is held in firm mechanical contact with the center support channel 25. Located toward the interior directly next to, but not in contact with each threaded rod 30 is a spacer bar 35. The spacer bar 35 is in firm mechanical contact with the center support channel 25. This spacer bar 35 allows for the staging and assembly of a wood panel 40. Located at the ends of each pair of threaded rods 30 is a clamping bar 45. This clamping bar has a circular hole at its lower end to receive the lower threaded rod 30 and an open slot at its upper end to receive the upper threaded rod 30. The open slot at the upper end of the clamping bar 45 also includes a locking pin 50, which when removed allows for the rapid placement and removal of the wood panel 40 by allowing the clamping bar 45 to be swung down out of the stock travel path depicted by arrow 55. Located at the end of each threaded rod 30 on the exterior side of each clamping bar 45 is a clamping washer and nut assembly 60. Each clamping washer and nut assembly 60, when tightened, would apply mechanical pressure to the wood panel 40 through the clamping bar 45. This mechanical pressure would aid the glueing and clamping process and prevent bowing of the wood panel 40 thus maintaining a flat uniform surface.

It is anticipated that the panel clamping and assembly rack 5 will be manufactured of a suitably strong material such as steel pipe, channel and/or bars, however, other equally strong materials may be used. It is also anticipated that firm mechanical contact between all items described above would be provided by welding or other equally strong connection means.

2. Operation of the Preferred Embodiment

In operation, the present invention is intended to be accessible in both cost and accessibility by the small shop or individual craftsman. To use the present invention with its preferred embodiment can best be described in conjunction with the front view of the present invention as shown in FIG. 1 and the sectional view of the present invention as shown in FIG. 3. The invention also utilizes low cost, conventional bar clamps and a large adjustable wrench. Much ordinarily wasted materials from preferably 1" to 2½" wide can be converted into valuable panel stock. Although different widths of stock can be utilized, it is recommended that when glueing wide panels up to 24" that stock 4" wide or less be used in order to minimize warpage. A 72-hour glue set up time may be required for purposes of allowing moisture form the glue to dissipate and equalized the moisture content of the wood. However, many modern glues currently available can dry much more quickly, with set up in as little as 20 minutes, and maximum strength achievable at 24 hours.

Before utilizing the current invention, paper may wish to be placed under the rack in order to catch any excess glue drippings.

To use the present invention, all stock to be used for glueing must be sawn straight on both edges for proper glue adhesion and quality. Neither jointing nor doweling of the edges are required. A length of stock is then inserted into the panel clamping and assembly rack 5, set upon the spacer bar 35 and the clamping bar 45 is adjusted loose on the stock. Glue is applied to the top edge of the stock. Additional stock pieces are then alternately stacked and glued until the desired width is reached. Next, firm pressure is applied to the clamping bar 45 by gently tightening the clamping washer and nut assembly 60 on the panel clamping and assembly rack 5 in order to keep stock pieces flush. Conventional bar clamps are applied at a quantity of one per foot of panel, e.g., 8 on an 8-foot panel; 10 for a 10-foot panel; etc. The clamping bar 45 are then tightened with an adjustable wrench. After ample drying time, the wood panel 40 is completed by loosening the clamping washer and nut assembly 60, removing the locking pin 50, and swinging the clamping bar 45 about the center of the lower threaded rod 30, removing the conventional bar clamps and finally removing the wood panel 40 via the panel travel path 55.

The foregoing description is included to illustrate the operation of the preferred embodiment and is not meant to limit the scope of the invention. The scope of the invention is to be limited only by the following claims.

What is claimed is:

1. An apparatus for gluing wood stock together in a vertical stack such that mating surfaces are each oriented horizontally, to prevent excess drippage of glue associated with gluing wood stock together such that mating surfaces are each oriented vertically, the apparatus comprising:

a. a frame having a base for resting upon a floor surface;

b. a plurality of spaced jigs attached to the frame along a length of the frame;

c. each jig comprising:

i. an elongated member oriented vertically when the base is resting on the floor surface;

ii. a clamping bar positioned on a side of the elongated member and oriented parallel to the elongated member;

iii. support and adjusting means for supporting the clamping bar and for adjusting the clamping bar toward and away from the elongated member;

iv. spacing and wood support means adapted to support wood stock and to prevent physical contact between the wood stock and the support and adjusting means when the wood stock is placed between the elongated member and the clamping bar; and d. the jigs adapted to retain vertical stacks of wood stock having mating surfaces oriented horizontally, between the clamping bar and the elongated member.

* * * * *